US009859077B2

(12) United States Patent
Sugisawa et al.

(10) Patent No.: US 9,859,077 B2
(45) Date of Patent: Jan. 2, 2018

(54) ELECTROMAGNETIC RELAY HAVING A TAPERED AND CIRCULAR MOVABLE CORE PORTION

(71) Applicant: Anden Co., Ltd., Anjo, Aichi-pref. (JP)

(72) Inventors: Masanao Sugisawa, Anjo (JP); Takashi Ito, Anjo (JP); Makoto Kamiya, Anjo (JP); Mitsugu Fujiwara, Anjo (JP); Tomoaki Tanaka, Anjo (JP)

(73) Assignee: ANDEN CO., LTD., Anjo, Aichi-pref. (JP)

( * ) Notice: Subject to any disclaimer, the term of this patent is extended or adjusted under 35 U.S.C. 154(b) by 0 days.

(21) Appl. No.: 15/022,311

(22) PCT Filed: Sep. 11, 2014

(86) PCT No.: PCT/JP2014/004685
§ 371 (c)(1),
(2) Date: Mar. 16, 2016

(87) PCT Pub. No.: WO2015/040834
PCT Pub. Date: Mar. 26, 2015

(65) Prior Publication Data

US 2016/0225565 A1 Aug. 4, 2016

(30) Foreign Application Priority Data

Sep. 19, 2013 (JP) ..... 2013-194120
Jun. 23, 2014 (JP) ..... 2014-128252

(51) Int. Cl.
*H01H 5/20* (2006.01)
*H01H 50/20* (2006.01)
(Continued)

(52) U.S. Cl.
CPC ..... *H01H 50/20* (2013.01); *H01H 50/16* (2013.01); *H01H 50/36* (2013.01); *H01H 50/56* (2013.01); *H01H 50/60* (2013.01); *H01H 50/163* (2013.01)

(58) Field of Classification Search
CPC ..... H01H 50/20; H01H 50/16; H01H 50/36; H01H 50/56; H01H 50/60; H01H 50/163
See application file for complete search history.

(56) References Cited

U.S. PATENT DOCUMENTS 2,407,603 A * 9/1946 Derungs ..... H01F 7/13 335/177
5,126,710 A * 6/1992 Schueller ..... H01H 71/322 335/78
6,700,466 B1 * 3/2004 Yamamoto ..... H01H 9/302 218/156
(Continued)

FOREIGN PATENT DOCUMENTS

CN 103282994 A 9/2013
JP 2011216785 A 10/2011
(Continued)

OTHER PUBLICATIONS

International Search Report and Written Opinion (in Japanese with English Translation) for PCT/JP2014/004685, dated Dec. 9, 2014; ISA/JP.

*Primary Examiner* — Bernard Rojas
(74) *Attorney, Agent, or Firm* — Harness, Dickey & Pierce, P.L.C.

(57) ABSTRACT

A fixed core includes: a fixed core tapered portion having a diameter increased in an attraction direction; and a fixed core circular portion having a fixed outer diameter and extending in the attraction direction from an end of the fixed core tapered portion. A movable core includes a movable core tubular portion in which a movable core hole is defined. The movable core hole is a space into which the fixed core tapered portion and the fixed core circular portion can enter. The movable core tubular portion includes: a movable core
(Continued)

cylindrical portion having a constant inner diameter; and a movable core tapered tubular portion having an inner diameter decreased from an end of the movable core cylindrical portion in a non-attraction direction.

14 Claims, 2 Drawing Sheets

(51) Int. Cl.

| | |
|---|---|
| ***H01H 50/16*** | (2006.01) |
| ***H01H 50/36*** | (2006.01) |
| ***H01H 50/56*** | (2006.01) |
| ***H01H 50/60*** | (2006.01) |

(56) References Cited

U.S. PATENT DOCUMENTS

| | | | | |
|---|---|---|---|---|
| 7,626,288 | B2 * | 12/2009 | Protze | H01F 3/14 335/209 |
| 2002/0060620 | A1 * | 5/2002 | Bircann | H01F 7/081 335/256 |
| 2010/0207713 | A1 * | 8/2010 | Sugisawa | H01H 50/54 335/192 |
| 2011/0241809 | A1 * | 10/2011 | Sugisawa | H01H 1/54 335/188 |
| 2012/0092098 | A1 | 4/2012 | Choi | |

FOREIGN PATENT DOCUMENTS

| | | | |
|---|---|---|---|
| JP | 2012089491 | A | 5/2012 |
| JP | 2013182711 | A | 9/2013 |
| WO | WO-2011125142 | A1 | 10/2011 |

* cited by examiner

ELECTROMAGNETIC RELAY HAVING A TAPERED AND CIRCULAR MOVABLE CORE PORTION

CROSS REFERENCE TO RELATED APPLICATIONS

This application is a U.S. National Phase Application under 35 U.S.C. 371 of International Application No. PCT/JP2014/004685 filed on Sep. 11, 2014 and published in Japanese as WO 2015/040834 A1 on Mar. 26, 2015. This application is based on and claims the benefit of priority from Japanese Patent Application No. 2013-194120 filed on Sep. 19, 2013 and Japanese Patent Application No. 2014-128252 filed on Jun. 23, 2014. The entire disclosures of all of the above applications are incorporated herein by reference.

TECHNICAL FIELD

The present disclosure relates to an electromagnetic relay that opens or closes en electric circuit.

BACKGROUND ART

Up to now, one of the electromagnetic relays of this type is disclosed in, for example, Patent Literature 1. The electromagnetic relay disclosed in Patent Literature 1 is configured so that an electromagnetic attraction force is generated between opposed surfaces of a movable core formed of a plate and a fixed core formed of a plate due to the energization of an exciting coil. The movable core is attracted toward the fixed core due to the electromagnetic attraction force.

The opposed surfaces of the movable core and the fixed core are inclined with respect to a moving direction of the movable core, thereby reducing an air gap between the opposed surfaces of the movable core and the fixed core. Thus, the electromagnetic attraction force is increased immediately after the exciting coil has started to be energized.

PRIOR ART LITERATURES

Patent Literature

Patent Literature 1: JP 2011-216785 A

SUMMARY OF INVENTION

However, in the conventional electromagnetic relay of Patent Literature 1, the movable core and the fixed core are each formed of a plate, and the opposed surfaces of the movable core and the fixed core are present at only two places in a direction orthogonal to a moving direction of the movable core. This makes it difficult to sufficiently increase opposed areas of the movable core and the fixed core, and further makes it difficult to obtain sufficient electromagnetic attraction force.

In view of the above, an object of the present disclosure is to provide an electromagnetic relay in which a sufficient electromagnetic attraction force can be obtained.

To attain the above object, according to an aspect of the present disclosure, an electromagnetic relay includes: an exciting coil that generates a magnetic field during energization; a fixed core disposed in a coil center hole defined in a center of the exciting coil to configure a magnetic circuit;

a yoke disposed to cover an outer peripheral side of the exciting coil and an end of the exciting coil in an axial direction to configure a magnetic circuit; a movable core that is attracted toward the fixed core during the energization of the exciting coil; a movable contact that moves to follow the movable core; and a fixed contact. The movable contact contacts with or separates from the fixed contact. A way of moving the movable core upon starting the energization of the exciting coil is defined as an attraction direction, and a way of moving the movable core upon blocking the energization of the exciting coil is defined as a non-attraction direction. The fixed core includes: a fixed core tapered portion having a diameter increased in the attraction direction from an end of the fixed core in the non-attraction direction; and a fixed core circular portion having a fixed outer diameter and extending in the attraction direction from an end of the fixed core tapered portion in the attraction direction. The movable core includes a movable core tubular portion in which a movable core hole is defined. The movable core hole is a space into which the fixed core tapered portion and the fixed core circular portion can enter. The movable core tubular portion includes: a movable core cylindrical portion having a constant inner diameter and extending in the non-attraction direction from an end of the movable core in the attraction direction; and a movable core tapered tubular portion having an inner diameter decreased in the non-attraction direction from an end of the movable core cylindrical portion in the non-attraction direction. When the energization of the exciting coil is blocked, a part of the fixed core tapered portion is located within the movable core hole, and the end of the movable core cylindrical portion in the attraction direction and the fixed core tapered portion overlap with each other in a direction perpendicular to the moving direction of the movable core. When the exciting coil is energized, the fixed core tapered portion and the fixed core circular portion are located within the movable core hole.

According to the above configuration, an inner peripheral surface of the movable core cylindrical portion is kept constant in the inner diameter. Therefore, when the energization is blocked or when the energization starts, an air gap can be reduced more than a case in which the inner peripheral surface of the movable core cylindrical portion is tapered in the same manner as that of the inner peripheral surface of the movable core tapered tubular portion. Accordingly, the electromagnetic attraction force can be increased when the energization starts.

The opposed surfaces of the fixed core tapered portion and the movable core tapered tubular portion are annularly continuous around the center axes of the fixed core and the movable core, and opposed areas of the opposed surfaces can be sufficiently increased. Therefore, the electromagnetic attraction force can be increased when the movable core is completely attracted.

Incidentally, in the conventional electromagnetic relay, a force (hereinafter referred to as "side force") in a direction perpendicular to the moving direction of the movable core always acts on the movable core, and the movable core is likely to be inclined. On the contrary, in the electromagnetic relay according to the present disclosure, the side force acting on the fixed core is prevented or suppressed to restrict the inclination of the movable core, because a magnetic flux continuously passes around the center axes of the fixed core and the movable core, between the opposed surfaces of the fixed core tapered portion as well as the fixed core circular portion and the movable core hole.

In the electromagnetic relay, abutment parts of the fixed core and the movable core when the exciting coil is energized may come in linear contact or point contact with each other.

Incidentally, when the fixed core comes in contact with the movable core, if the attraction force (in other words, the peak attraction force) is excessive, a collision speed of the fixed core and the movable core becomes higher, and a collision sound also becomes larger. When the peak attraction force is excessive, a return voltage becomes lower, and the fixed core and the movable core cannot be returned to original positions by a desired return voltage.

On the contrary, because the fixed core and the movable core are brought into linear contact or point contact with each other to suppress the peak attraction force, the collision sound can be reduced, and the fixed core and the movable core can be returned to the original positions by the desired return voltage.

The electromagnetic relay may further include: a shaft that is coupled to the movable core; and a support member that slidably supports the shaft. At least a part of the movable core is inserted into the coil center hole, and the movable core is slidably supported by the exciting coil.

According to the above configuration, because the member that moves integrally with the movable core is supported at two points, the inclination of the movable core is suppressed. Therefore, the air gap between the fixed core tapered portion and the tapered hole can be narrowed, such that the electromagnetic attraction force can be further increased. Moreover, a contact reliability between the movable contact and the fixed contact can be improved.

In the electromagnetic relay, a fixed core hole may be defined in the fixed core, and a shaft may be coupled with the movable core. At least a part of the shaft is inserted into the fixed core hole, and the shaft is slidably supported by the fixed core.

According to the above configuration, because the number of components involved in the dimensions of the air gap is smaller, a variation in the air gap can be reduced.

DESCRIPTION OF EMBODIMENTS

Figure 1:
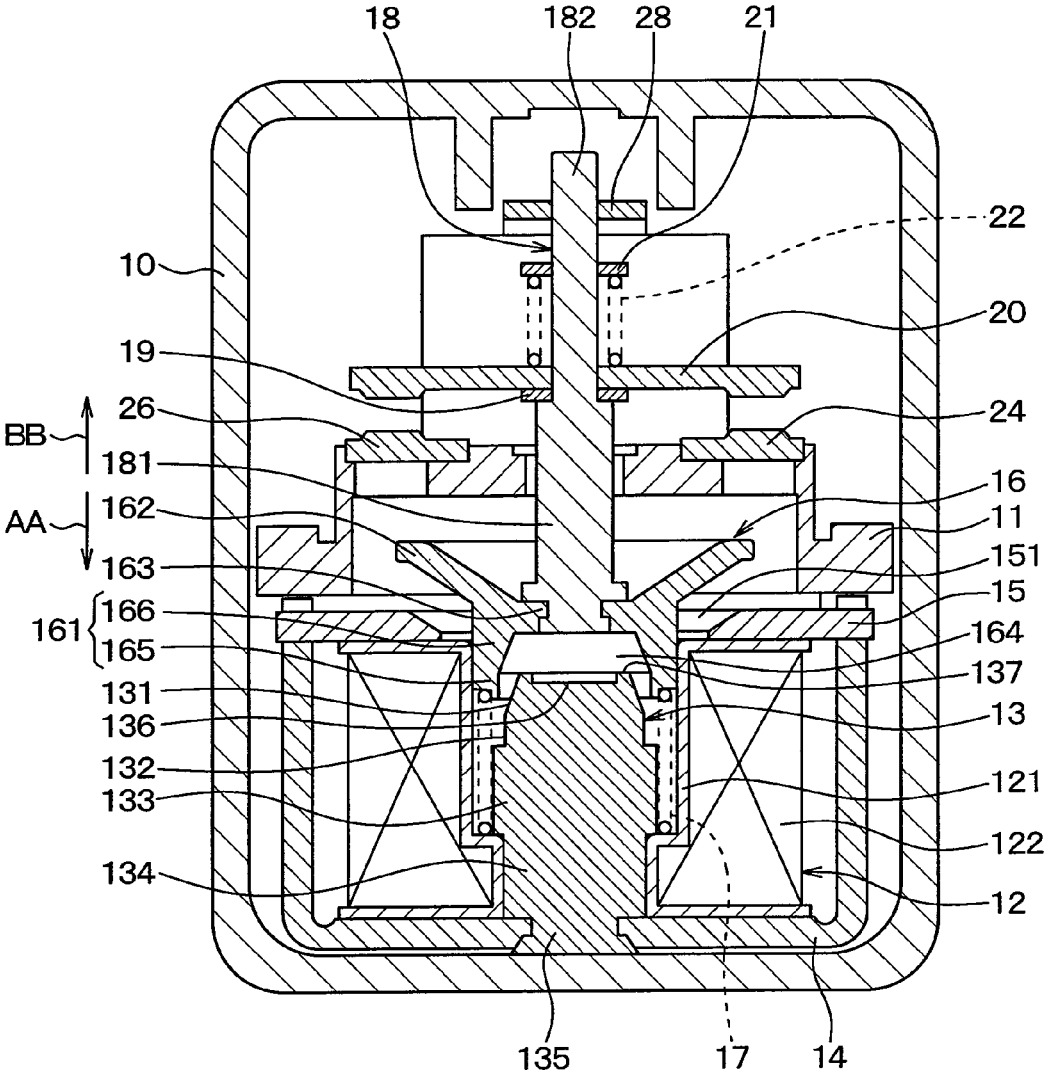
FIG. 1 is a cross-sectional view illustrating an electromagnetic relay according to a first embodiment.

Hereinafter, embodiments will be described according to the drawings. Same or equivalent portions among respective embodiments below are labeled with same reference numerals in the drawings.

First Embodiment

A first embodiment is described.

In the following description, a way of moving a movable core 16 by starting the energization of an exciting coil 12 is called "attraction direction AA", and a way of moving the movable core 16 by blocking the energization of the exciting coil 12 is called "non-attraction direction BB". The attraction direction AA and the non-attraction direction BB are called "moving direction of movable core" together. The non-attraction direction BB is also called "anti-attraction direction" or "release direction", and means a direction opposite to the attraction direction AA in the moving direction of the movable core.

As illustrated in FIG. 1, a base 11 that is made of resin is disposed within a case 10 made of resin, and holds components. The base 11 is fixed to the case 10 by adhesive or fitting such as claw.

The exciting coil 12 having a cylindrical shape and generating a magnetic field during the energization is disposed within the case 10. The exciting coil 12 includes a spool 121 made of resin, and a coil part 122 formed by winding a conductive wire on the spool 121.

A fixed core 13 made of a magnetic metal material is disposed in a hole of the exciting coil 12 at a radial center (in more detail, hole at the radial center of the spool 121). The fixed core 13 is formed into a substantially cylindrical shape, and a center axis of the fixed core 13 coincides with the moving direction of the movable core.

The fixed core 13 includes a fixed core tapered portion 131 that is increased in diameter in the attraction direction AA from an end (that is, an end adjacent to the movable core 16) of the fixed core 13 in the non-attraction direction BB, and a fixed core first circular part 132 extending in the attraction direction AA from an end of the fixed core tapered portion 131 in the attraction direction AA and having an outer diameter which is uniform. The fixed core first circular part 132 corresponds to a fixed core circular portion.

The fixed core 13 includes a fixed core second circular part 133 that extends in the attraction direction AA from an end of the fixed core first circular part 132 in the attraction direction AA with a constant outer diameter larger than that of the fixed core first circular part 132, and a fixed core third circular part 134 that extends in the attraction direction AA from an end of the fixed core second circular part 133 in the attraction direction AA with a constant outer diameter smaller than that of the fixed core second circular part 133.

The fixed core 13 includes a fixed core fourth circular part 135 that extends in the attraction direction AA from an end of the fixed core third circular part 134 in the attraction direction AA with a constant outer diameter smaller than that of the fixed core third circular part 134.

Furthermore, an end of the fixed core 13 in the non-attraction direction BB (that is, an end surface of the fixed core tapered portion 131) has a fixed core concave portion 136 which is a cylindrical concave space formed at the center, and a fixed core convex portion 137 that is annularly continuously protruded around the fixed core concave portion 136.

An outer peripheral side of the exciting coil 12 and one end of the exciting coil 12 in an axial direction (that is, an end of the exciting coil 12 in the attraction direction AA) are covered with a first yoke 14 obtained by bending a plate made of a magnetic metal material into a substantially U-shape.

The other end of the exciting coil 12 in the axial direction (that is, an end of the exciting coil 12 in the non-attraction direction BB) is covered with a second yoke 15 having a rectangular plate shape made of a magnetic metal material. A yoke hole 151 is defined in the second yoke 15, and penetrates through a center of the second yoke 15. A surface of the yoke hole 151 of the second yoke 15 is tapered to be increased in diameter in the non-attraction direction BB.

An end of the fixed core fourth circular part 135 of the fixed core 13 is swaged to couple the fixed core 13 with the first yoke 14. The first yoke 14 and the second yoke 15 are coupled with each other by a swage. Further, the first yoke 14 is coupled with the base 11 by press fitting.

The movable core 16 made of a magnetic metal material is disposed at a position facing the fixed core 13 and the second yoke 15. The movable core 16 is substantially cylindrical, and a center axis of the movable core 16 coincides with the moving direction of the movable core. The fixed core 13, the first yoke 14, the second yoke 15, and the movable core 16 configure a magnetic circuit of a magnetic flux induced by the exciting coil 12.

The movable core 16 includes a cylindrical movable core tubular portion 161 having a constant outer diameter, a movable core flange part 162, and a movable core center plate part 163 that is located on the inner side of the movable core cylindrical portion 161 and the movable core flange part 162. The movable core flange part 162 has a dish spring shape with inner and outer peripheral surfaces each increased in diameter in the non-attraction direction BB, and is located adjacent to the movable core tubular portion 161 in the non-attraction direction BB.

The movable core tubular portion 161 is disposed in the yoke hole 151, and slidably supported in the hole of the exciting coil 12 at the radial center.

A movable core hole 164 that is a space into which the fixed core tapered portion 131 and the fixed core first circular part 132 can enter is formed inside of the movable core tubular portion 161.

The movable core tubular portion 161 includes a movable core cylindrical portion 165 having a constant inner diameter and extending in the non-attraction direction BB from an end (that is, an end adjacent to the fixed core 13) of the movable core 16 in the attraction direction AA, and a movable core tapered tubular portion 166 whose inner peripheral surface is decreased in diameter in the non-attraction direction BB from an end of the movable core cylindrical portion 165 in the non-attraction direction BB.

The movable core flange part 162 faces a surface of the second yoke 15 in the non-attraction direction BB, and a tapered surface of the second yoke 15 which defines the yoke hole 151.

The movable core center plate part 163 faces an end of the fixed core 13 in the non-attraction direction BB (that is, an end surface of the fixed core tapered portion 131).

A return spring 17 that urges the movable core 16 in the non-attraction direction BB is disposed between the exciting coil 12 and the movable core 16. With the energization of the exciting coil 12, the movable core 16 is attracted toward the fixed core 13 against the return spring 17 due to the electromagnetic attraction force (that is, moves in the attraction direction AA).

The movable core 16 is coupled with a shaft 18 made of metal. The shaft 18 is formed into a substantially cylindrical shape, and a center axis of the shaft 18 coincides with the moving direction of the movable core. The shaft 18 includes a shaft first cylindrical portion 181, and a shaft second cylindrical portion 182 that is located adjacent to the shaft first cylindrical portion 181 in the non-attraction direction BB. The shaft second cylindrical portion 182 has a diameter smaller than that of the shaft first cylindrical portion 181.

An end of the shaft first cylindrical portion 181 in the attraction direction AA is inserted into a hole defined in a radial center of the movable core center plate part 163, and the end of the shaft first cylindrical portion 181 is swaged to couple the movable core 16 with the shaft 18. The movable core 16 and the shaft 18 may be integrally made of the same member as one-piece.

The shaft 18 penetrates through a hole defined at the radial center of the base 11. A portion of the shaft 18 projected from the base 11 (that is, the shaft second cylindrical portion 182) is fitted with a first snap ring 19, and slidably attached with a movable contact 20 formed of a conductive metal plate.

A second snap ring 21 is fixed to an intermediate part of the shaft second cylindrical portion 182. A contact pressure spring 22 is disposed between the second snap ring 21 and the movable contact 20. The contact pressure spring 22 urges the movable contact 20 in the attraction direction AA (that is, toward the first snap ring 19). The movable contact 20 has two or more convex contact points. The contact points may be replaced with contacts of another member.

A first fixed contact 24 formed of a conductive metal plate has one or more convex contacts, and a second fixed contact 26 formed of a conductive metal plate has one or more convex contacts. The contact points may be replaced with contacts of another member.

The first fixed contact 24 and the second fixed contact 26 are fixed to the base 11, and the total number of contacts of the first fixed contact 24 and the second fixed contact 26 is identical with the number of contacts of the movable contact 20. The contacts of the first fixed contact 24 and the second fixed contact 26 are located to face the respective contacts of the movable contact 20.

The movable contact 20 moves to follow the movable core 16. As a result, the contacts of the movable contact 20 contact with or separate from the contacts of the first fixed contact 24 and the second fixed contact 26. Thus, the first fixed contact 24 is electrically connected to or disconnected from the second fixed contact 26.

A support member 28 formed of a metal plate is fixed to the base 11. The shaft second cylindrical portion 182 is slidably inserted into a through-hole defined in the support member 28.

Subsequently, the operation of the electromagnetic relay according to this embodiment will be described.

First, when the energization of the exciting coil 12 is blocked, the movable core 16, the shaft 18, and the movable contact 20 are driven by the return spring 17 in the non-attraction direction BB. As a result, as illustrated in FIG. 1, the contact points of the movable contact 20 are separated from the contact points of the first fixed contact 24 and the second fixed contact 26, and the first fixed contact 24 and the second fixed contact 26 are electrically disconnected from each other.

In a state where the energization of the exciting coil 12 is blocked, a part of the fixed core tapered portion 131 is located within the movable core hole 164, and the end part of the movable core cylindrical portion 165 in the attraction direction AA overlaps with the fixed core tapered portion 131 in a direction perpendicular to the moving direction of the movable core.

On the other hand, when the exciting coil 12 is energized, the movable core 16 is attracted toward the fixed core 13 against the return spring 17 due to the electromagnetic attraction force, and the shaft 18 and the movable contact 20 follow the movable core 16 moving in the attraction direction AA. As a result, the contact points of the movable contact 20 abut against the contact points of the first fixed contact 24 and the second fixed contact 26, and the first fixed contact 24 and the second fixed contact 26 are electrically connected to each other.

When the exciting coil 12 is energized, the movable core 16 moves to a position where the movable core center plate part 163 abuts against the fixed core convex portion 137. In a state where the movable core center plate part 163 abuts the fixed core convex portion 137, the fixed core tapered portion 131 and the fixed core first circular part 132 are located within the movable core hole 164.

According to this embodiment, at the time of starting the energization of the exciting coil 12, as with a case in which the energization of the exciting coil 12 is blocked, the end part of the movable core cylindrical portion 165 in the attraction direction AA overlaps with the fixed core tapered portion 131 in the direction perpendicular to the moving direction of the movable core. Because an inner peripheral surface of the movable core cylindrical portion 165 has a constant inner diameter, the air gap at the time of starting the energization can be reduced, and the electromagnetic attraction force at the time of starting the energization can be increased, as compared with a case in which the inner peripheral surface of the movable core cylindrical portion 165 is tapered as with the inner peripheral surface of the movable core tapered tubular portion 166 (that is, a case in which the overall inner peripheral surface of the movable core hole 164 is tapered).

When the movable core 16 moves in the attraction direction AA due to the energization of the exciting coil 12, a magnetic flux passes at all positions around the center axes of the fixed core 13 and the movable core 16 between the opposed surfaces of the fixed core tapered portion 131 as well as the fixed core first circular part 132, and the movable core tubular portion 161. Therefore, a side force acting on the movable core 16 is prevented or suppressed, such that the inclination of the movable core 16 is suppressed.

Because the opposed surfaces of the fixed core tapered portion 131 as well as the fixed core first circular part 132, and the movable core tubular portion 161 are annularly continuous around the center axes of the fixed core 13 and the movable core 16, an opposed area of the opposed surfaces can be sufficiently increased. Therefore, the electromagnetic attraction force can be increased during the attraction or at the time of completing the attraction.

When the exciting coil 12 is energized, because the movable core center plate part 163 abuts against the annular fixed core convex portion 137, in other words, because the fixed core 13 and the movable core 16 come in linear contact with each other, a peak attraction force is suppressed. Therefore, a collision sound between the fixed core 13 and the movable core 16 can be reduced, and the fixed core 13 and the movable core 16 can be returned to original positions by a desired return voltage.

Further, the movable core tubular portion 161 is slidably supported by the exciting coil 12, and the shaft second cylindrical portion 182 is slidably supported by the support member 28. In other words, because the member moving integrally with the movable core 16 is supported at the two points, the inclination of the movable core 16 is suppressed. Therefore, the air gap between the fixed core tapered portion 131 as well as the fixed core first circular part 132, and the movable core tubular portion 161 can be narrowed, such that the electromagnetic attraction force can be further increased. A contact reliability between the movable contact 20, and the first fixed contact 24 as well as the second fixed contact 26 can be improved.

Second Embodiment

Next, a second embodiment will be described. This embodiment enables to reduce a variation in an air gap, and hereinafter only parts different from those in the first embodiment will be described.

In this embodiment, the second snap ring 21 and the support member 28 in the first embodiment are eliminated.

Figure 2:
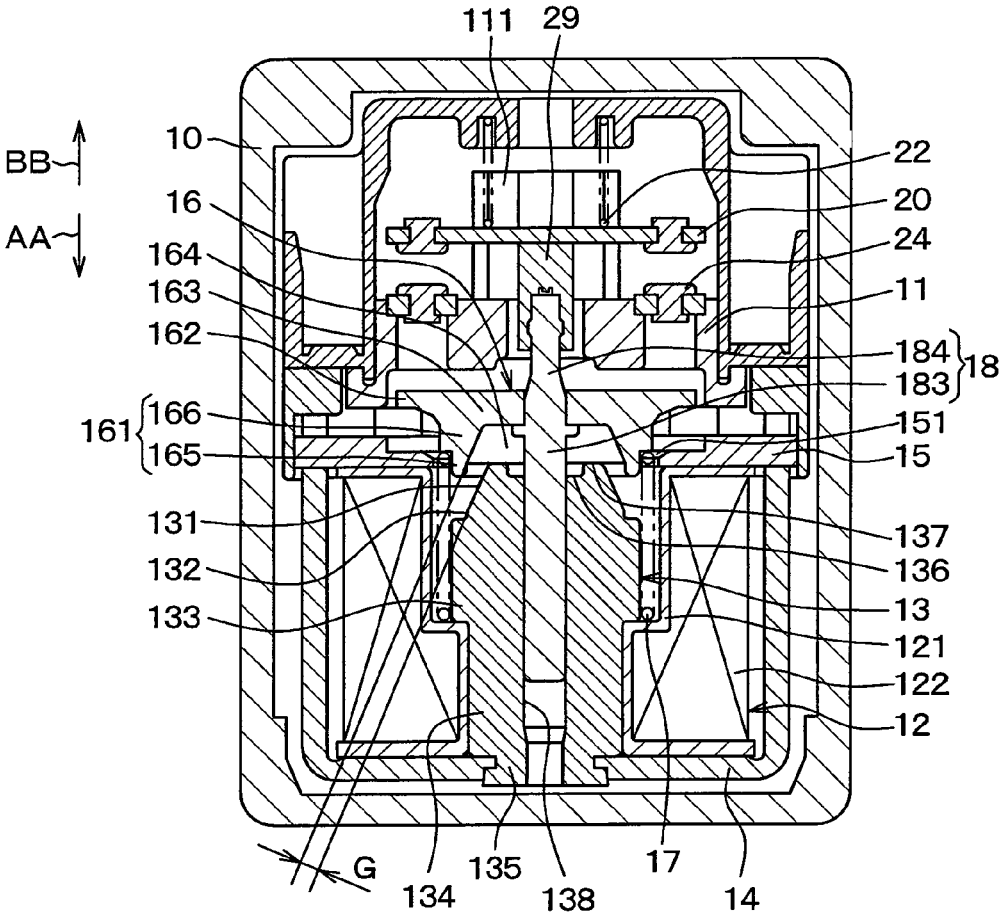
FIG. 2 is a cross-sectional view illustrating an electromagnetic relay according to a second embodiment.

As illustrated in FIG. 2, a fixed core hole 138 extending in an axial direction of a fixed core 13 is defined at a radial center of the fixed core 13, and the fixed core 13 is formed into a substantially cylindrical shape.

In a movable core 16, a surface of a movable core flange part 162 in a non-attraction direction BB is made flat.

A shaft 18 includes a shaft third cylindrical portion 183 extending from a coupling position with the movable core 16 in an attraction direction AA, and a shaft fourth cylindrical portion 184 extending from the coupling position with the movable core 16 in the non-attraction direction BB.

The shaft third cylindrical portion 183 is inserted into the fixed core hole 138, such that the shaft 18 is slidably supported by the fixed core 13. In this embodiment, the movable core 16 is not supported by an exciting coil 12.

An insulator 29 is installed on an end of the shaft fourth cylindrical portion 184, and an end of the insulator 29 abuts against a movable contact 20.

A guide part 111 that guides the movable contact 20 is formed integrally with a base 11. In more detail, the guide part 111 is disposed on a near side and a depth side relative to a paper surface of FIG. 2, and restricts a movable area of the movable contact 20 in a perpendicular direction and a right-left direction of the paper surface of FIG. 2.

Meanwhile, when the movable core 16 is inclined with respect to the fixed core 13, an air gap G between a fixed core tapered portion 131 and a movable core tapered tubular portion 166 is varied depending on the position in the circumferential direction. The variation in the air gap G depending on the position in the circumferential direction becomes larger as the inclination of the movable core 16 relative to the fixed core 13 is larger.

In the first embodiment, the base 11, the fixed core 13, the first yoke 14, the movable core 16, the shaft 18, the support member 28, and the spool 121 are involved in the inclination of the movable core 16 relative to the fixed core 13, and also involved in the variation in the air gap G depending on the position in the circumferential direction. In more detail, a dimensional precision and a shape precision of each component, and an assembly precision of the respective components are involved in the inclination of the movable core 16 relative to the fixed core 13.

On the other hand, in the second embodiment, only the fixed core 13, the movable core 16, and the shaft 18 are involved in the inclination of the movable core 16 relative to the fixed core 13.

As described above, in the second embodiment, because the number of components involved in the inclination of the movable core 16 relative to the fixed core 13 is small, the variation in the air gap G depending on the position in the circumferential direction can be reduced.

Other Embodiments

In the above respective embodiments, the annular fixed core convex portion 137 is formed, and the fixed core 13 comes in linear contact with the movable core 16 when the exciting coil 12 is energized. Alternatively, the fixed core convex portion 137 may be configured by multiple protrusions arranged along the circumferential direction, such that the fixed core 13 may come in point contact with the movable core 16 when the exciting coil 12 is energized.

It should be appreciated that the present disclosure is not limited to the embodiments described above and can be modified appropriately within the scope of the appended claims.

In the respective embodiments above, it goes without saying that elements forming the embodiments are not necessarily essential unless specified as being essential or deemed as being apparently essential in principle.

In a case where a reference is made to the components of the respective embodiments as to numerical values, such as the number, values, amounts, and ranges, the components are not limited to the numerical values unless specified as being essential or deemed as being apparently essential in principle.

Also, in a case where a reference is made to the components of the respective embodiments above as to shapes and positional relations, the components are not limited to the shapes and the positional relations unless explicitly specified or limited to particular shapes and positional relations in principle.

What is claimed is:

1. An electromagnetic relay comprising:

an exciting coil that generates a magnetic field during energization;

a fixed core disposed in a coil center hole defined in a center of the exciting coil to configure a magnetic circuit;

a yoke disposed to cover an outer peripheral side of the exciting coil and an end of the exciting coil in an axial direction to configure a magnetic circuit;

a movable core that is attracted toward the fixed core during the energization of the exciting coil;

a movable contact that moves to follow the movable core; and a fixed contact, wherein the movable contact contacts with or separates from the fixed contact; wherein a direction the movable core moves upon starting the energization of the exciting coil is defined as an attraction direction, and a direction the movable core moves upon blocking the energization of the exciting coil is defined as a non-attraction direction, the fixed core includes:

a fixed core tapered portion having a diameter increased in the attraction direction from an end of the fixed core in the non-attraction direction; and a fixed core circular portion having a fixed outer diameter and extending in the attraction direction from an end of the fixed core tapered portion in the attraction direction, the movable core includes:

a movable core tubular portion in which a movable core hole is defined, the movable core hole being a space into which the fixed core tapered portion and the fixed core circular portion are able to enter;

a movable core flange part having a dish spring shape with inner and outer peripheral surfaces each increased in diameter in the non-attraction direction and located adjacent to the movable core tubular portion in the non-attraction direction, and a movable core center plate part that is located on the inner side of the movable core tubular portion and the movable core flange part, the movable core tubular portion includes:

a movable core cylindrical portion having a constant inner diameter and extending in the non-attraction direction from an end of the movable core in the attraction direction; and a movable core tapered tubular portion having an inner diameter decreased in the non-attraction direction from an end of the movable core cylindrical portion in the non-attraction direction; wherein a part of the fixed core tapered portion is located within the movable core hole, and an end part of the movable core cylindrical portion in the attraction direction and the fixed core tapered portion overlap with each other in a direction perpendicular to the direction the movable core moves when the energization of the exciting coil is blocked, and the fixed core tapered portion and the fixed core circular portion are located within the movable core hole when the exciting coil is energized.

2. The electromagnetic relay according to claim 1, wherein when the exciting coil is energized, an abutment part of the fixed core and an abutment part of the movable core come in linear contact or point contact with each other.

3. The electromagnetic relay according to claim 1, further comprising:

a shaft coupled to the movable core; and a support member that slidably supports the shaft, wherein at least a part of the movable core is inserted into the coil center hole, and the movable core is slidably supported by the exciting coil.

4. The electromagnetic relay according to claim 1, wherein a fixed core hole is defined in the fixed core, a shaft is coupled with the movable core, and at least a part of the shaft is inserted into the fixed core hole, and the shaft is slidably supported by the fixed core.

5. The electromagnetic relay according to claim 4, wherein an end surface of the movable core in the non-attraction direction has a movable core flange part that is flat, the shaft passes through the fixed core hole defined at a radial center of the fixed core to extend in an axial direction of the fixed core, and only the fixed core, the movable core, and the shaft are involved in an inclination of the movable core relative to the fixed core.

6. The electromagnetic relay according to claim 5, wherein the shaft includes a shaft third cylindrical portion extending from a coupling position with the movable core in the attraction direction, and a shaft fourth cylindrical portion extending from the coupling position with the movable core in the non-attraction direction, and the shaft third cylindrical portion passes through the fixed core hole, such that the shaft is slidably supported by the fixed core.

7. The electromagnetic relay according to claim 6, further comprising:

an insulator arranged on an end of the shaft fourth cylindrical portion, wherein an end of the insulator abuts against the movable contact; and a guide part that guides the movable contact, wherein the guide part restricts a movable area of the movable contact.

8. The electromagnetic relay according to claim 1, wherein a length of the movable core cylindrical portion in the axial direction is smaller than a length of the fixed core tapered portion in the axial direction.

9. The electromagnetic relay according to claim 1, further comprising:

a return spring that urges the movable core in the non-attraction direction, wherein the return spring is disposed between the exciting coil and the movable core.

10. The electromagnetic relay according to claim 1, wherein the fixed core circular portion is a fixed core first circular part, the fixed core includes a fixed core second circular part that extends in the attraction direction from an end of the fixed core first circular part in the attraction direction with a constant outer diameter larger than that of the fixed core first circular part, and a fixed core third circular part that extends in the attraction direction from an end of the fixed core second circular part in the attraction direction with a constant outer diameter smaller than that of the fixed core second circular part.

11. The electromagnetic relay according to claim 1, wherein an end of the fixed core in the non-attraction direction has a fixed core concave portion which is a cylindrical concave space formed at the center, and a fixed core convex portion that is annularly continuously protruded around the fixed core concave portion.

12. The electromagnetic relay according to claim 1, wherein the movable core cylindrical portion fully encircles a portion of the fixed core tapered portion the direction perpendicular to the direction the movable core moves when the energization of the exciting coil is blocked.

13. The electromagnetic relay according to claim 1, wherein the movable core tubular portion includes only one movable core tapered tubular portion.

14. An electromagnetic relay comprising:

an exciting coil that generates a magnetic field during energization;

a fixed core disposed in a coil center hole defined in a center of the exciting coil to configure a magnetic circuit;

a yoke disposed to cover an outer peripheral side of the exciting coil and an end of the exciting coil in an axial direction to configure a magnetic circuit;

a movable core that is attracted toward the fixed core during the energization of the exciting coil;

a movable contact that moves to follow the movable core;

a fixed contact, wherein the movable contact contacts with or separates from the fixed contact;

a fixed core hole is defined in the fixed core:

a shaft is coupled with the movable core; and at least a part of the shaft is inserted into the fixed core hole, and the shaft is slidably supported by the fixed core; wherein a direction the movable core moves upon starting the energization of the exciting coil is defined as an attraction direction, and a direction the movable core moves upon blocking the energization of the exciting coil is defined as a non-attraction direction, the fixed core includes:

a fixed core tapered portion having a diameter increased in the attraction direction from an end of the fixed core in the non-attraction direction; and a fixed core circular portion having a fixed outer diameter and extending in the attraction direction from an end of the fixed core tapered portion in the attraction direction, the movable core includes a movable core tubular portion in which a movable core hole is defined, the movable core hole being a space into which the fixed core tapered portion and the fixed core circular portion are able to enter, the movable core tubular portion includes:

a movable core cylindrical portion having a constant inner diameter and extending in the non-attraction direction from an end of the movable core in the attraction direction; and a movable core tapered tubular portion having an inner diameter decreased in the non-attraction direction from an end of the movable core cylindrical portion in the non-attraction direction; wherein a part of the fixed core tapered portion is located within the movable core hole, and an end part of the movable core cylindrical portion in the attraction direction and the fixed core tapered portion overlap with each other in a direction perpendicular to the direction the movable core moves when the energization of the exciting coil is blocked, the fixed core tapered portion and the fixed core circular portion are located within the movable core hole when the exciting coil is energized, an end surface of the movable core in the non-attraction direction has a movable core flange part that is flat, the shaft passes through the fixed core hole defined at a radial center of the fixed core to extend in an axial direction of the fixed core, and only the fixed core, the movable core, and the shaft are involved in an inclination of the movable core relative to the fixed core.

* * * * *